United States Patent [19]

Blackburne

[11] 4,204,680

[45] May 27, 1980

[54] RACKETS

[76] Inventor: Robin M. Blackburne, Ardsheal Cottage, Paget 6-20, Bermuda

[21] Appl. No.: 895,021

[22] Filed: Apr. 10, 1978

[30] Foreign Application Priority Data

Apr. 20, 1977 [GB] United Kingdom ..... 16502/77

[51] Int. Cl.[2] ..... A63B 51/06

[52] U.S. Cl. ..... 273/73 D

[58] Field of Search ..... 273/67 R, 76, 73 R, 273/73 A, 73 C, 73 D, 73 E, 73 F, 73 G, 73 H

[56] References Cited

U.S. PATENT DOCUMENTS

| | | | |
|---|---|---|---|
| 364,596 | 6/1887 | Luce | 273/73 C |
| 1,409,621 | 3/1922 | Tournier | 273/73 D |
| 1,502,845 | 7/1924 | Blache | 273/73 D |
| 1,937,787 | 12/1933 | Robinson | 273/73 D |
| 2,610,056 | 9/1952 | Lovell | 273/73 D |
| 3,086,777 | 4/1963 | Lacoste | 273/73 H |
| 3,545,756 | 12/1970 | Nash | 273/73 D X |
| 3,642,283 | 2/1972 | Wilkens | 273/73 H X |
| 3,664,669 | 5/1972 | Latham et al. | 273/73 D |
| 3,702,701 | 11/1972 | Vaughn et al. | 273/73 H |
| 3,814,423 | 6/1974 | Shockley et al. | 273/73 C |
| 3,968,966 | 7/1976 | D'Aquanni | 273/73 D |
| 4,049,269 | 9/1977 | Blackburne | 273/73 D |

FOREIGN PATENT DOCUMENTS

| | | | |
|---|---|---|---|
| 25758 | 12/1935 | Australia | 273/73 D |
| 546787 | 4/1956 | Belgium | 273/73 D |
| 855902 | 2/1940 | France | 273/73 D |
| 1212195 | 10/1959 | France | 273/73 D |
| 308297 | 5/1933 | Italy | 273/73 D |
| 11774 | of 1884 | United Kingdom | 273/73 D |
| 3471 | of 1902 | United Kingdom | 273/73 D |
| 217778 | 6/1924 | United Kingdom | 273/73 D |
| 237395 | 7/1925 | United Kingdom | 273/73 D |
| 244566 | 12/1925 | United Kingdom | 273/73 F |
| 269955 | 5/1927 | United Kingdom | 273/73 D |
| 428582 | 5/1935 | United Kingdom | 273/76 |
| 485545 | 5/1938 | United Kingdom | 273/76 |

*Primary Examiner*—Richard J. Apley
*Attorney, Agent, or Firm*—Brisebois & Kruger

[57] ABSTRACT

This invention relates to a games racket, such as a tennis racket which is "double-strung", i.e. the stringing is disposed in two generally parallel planes located on opposite sides of the head frame. The head frame has a cross-sectional profile generally resembling an "extended D" having a body portion and extensions projecting transversely from opposite ends of the upright limb of the "D" to define the side walls of a generally radially outwardly opening channel of which the body of the "D" forms the base. The channel extends around the outer periphery of the head frame and the apertures which receive and locate the stringing open into the channel through said extensions. The stringing is knotted-off within the channel, and the channel also accommodates interconnecting portions of the stringing which interconnect the string portions making up the two playing surfaces in the two planes.

8 Claims, 32 Drawing Figures

RACKETS

BACKGROUND OF THE INVENTION

The present invention relates to rackets for playing tennis, squash, badminton, racketball or other games.

Coventional games rackets which are currently used and are commercially available have their playing surfaces formed by opposite sides of interwoven stringing lying in a single median or central plane of the head frame of the racket.

It has previously been proposed to replace the single, central set of interwoven stringing by two sets disposed in generally parallel planes spaced apart by a distance approximating the thickness of the head frame. Whilst such a "double-strung" racket construction possesses significant advantages over "centrally-strung" rackets, it also presents specific problems which are believed to account for the fact that such double-strung rackets have not previously been produced on a commercial scale.

A major problem occurs in achieving the required precise overall weight of the racket, weight of the racket head, and balance. These factors are all critical, and, for example, modern tournament tennis players in general favour tennis rackets weighing of the order of 13 to 13½ ounces or less, the weight and weight distribution being critical within narrow limits amounting to small fractions of an ounce. However, since the head frame of a double-strung racket carries two sets of tensioned stringing it must be able to withstand approximately twice the inward loading created by the tension of the stringing of a conventional centrally-strung racket. This requires the head frame to be strengthened, and this has in the past necessitated increasing the amount of material in the head frame, thereby unacceptably increasing the head weight and unbalancing the racket by making it head heavy. This is aggrevated by the extra weight contributed by the additional set of stringing which can, for example add to the head weight by approximately ½ ounce.

This problem is substantially reduced by the double-strung racket constructions disclosed in my U.S. Pat. No: 4,049,269, to which reference should be made. For example, in the embodiment described with reference to FIGS. 4 to 8, the stringing is located by, and passes through apertures which extend transversely between opposite side surfaces of the head frame, the apertures being formed in a strip which is carried by, overlies, and extends circumferentially around, the outer peripheral surface of the main structural part of the head frame. Thus, the structural frame part is not weakened by the provision of stringing-receiving apertures or grooves, and the strip, which forms part of the head frame, may also reinforce the structural frame part.

Whilst the rackets disclosed in my aforesaid Specification are particularly advantageous, these rackets, as well as previously proposed double-strung rackets, give rise to other problems. One of these concerns the "tying-off" or "knotting off" of the ends of the stringing, which ends number at least four and possibly upto eight. It has been found to be undesirable to "knot-off" on the opposite side surfaces of the frame, since this is unsightly, and it also renders the playing surfaces uneven. In addition, the knots block the associated stringing-receiving apertures, rendering it difficult or impossible to pass further portions of the stringing therethrough, either during initial stringing or when partial re-stringing is required.

Another problem concerns the appearance of the stringing. From a stress and an aesthetic viewpoint, the portions of the stringing in one plane or set should preferably extend parallel to the opposing portions of the stringing in the other plane or set. Whilst this can be achieved in one of two basic ways with the rackets disclosed in my aforesaid Specification, both possess disadvantages. Firstly, the stringing-receiving apertures can be inclined so that they are not perpendicular to the planes of the opposite side surfaces of the head frame, but this considerably complicates production of the apertures. Secondly, stringing sequences or systems can be employed which involve passing the stringing circumferentially along one or both opposite side surface between adjacent perpendicular apertures. However, this subjects the opposite side surfaces of the frame to uneven circumferential tensions tending to warp the frame. In addition, the stringing has to pass an increased number of times through at least some of the individual apertures, and in particular at least four times through four or five apertures, requiring the internal diameter of those apertures to be excessively increased. Neither of these two systems solve the previously mentioned "knotting-off" problem.

Further problems occur in obtaining the required stiffness of the frame, since the stresses imposed on the frame of a double-strung racket are not only greater than, but also different from, those imposed on a centrally-strung racket. Firstly, when a ball stikes one of the playing surfaces of a double-strung racket, the resultant deflection of that playing surface inwardly towards the other playing surface tends to roll or twist the frame inwardly. This tendency is greater with a double-strung racket, since the deflected playing surface is effectively attached to the associated side surface of the frame, not to the centre of the inner peripheral surface of the frame. Although the tension in the stringing portions of the other playing surface opposes this rolling or twisting tendency, the stringing portions are resilient, and the frame itself should therefore possess superior roll or torsional stiffness to resist this tendency.

Secondly, it is one of the principle advantages of a double-strung racket that a ball may strike the marginal zones of its playing surface, over or adjacent the frame, without being uncontrollably deflected as in a "wood" shot with a centrally-strung racket. However, with such an off-centre shot, particularly where the ball strikes the toe or tip of the racket opposite the handle, the power of the return shot will be reduced and the racket will, to the player, feel slightly "dead", if the frame is relatively weak or flexible in bend. Therefore, in order to achieve the required good response and feel to such off-centre strokes, the frame must possess superior stiffness in bend.

It is an object of the present invention to provide a frame construction for a double-strung racket which enables at least some of the previously mentioned problems to be overcome or substantially alleviated.

SUMMARY OF THE INVENTION

According to the present invention, there is provided a games racket comprising a handle intended to be held in the hand, and carrying a head having a frame defining a central opening, across which extends tensioned stringing carried by the head, the stringing being composed of two sets of stringing, with each set being disposed in a respective one of two spaced generally parallel planes, the stringing passing through apertures distributed around the periphery of the frame and opening at their outer ends into opposite side surfaces of the frame which are spaced apart in a direction generally normal to the planes of the stringing, the frame being provided in its outer periphery with a channel extending around the central opening, and the stringing-receiving apertures, intermediate their outer ends, opening into the channel.

The cross-sectional profile of the frame preferably resembles a "C" or an "extended D". The limbs of the "C" or the "extensions" of the "D" comprise a pair of flanges which define the side walls of the channel and are formed with the stringing-receiving apertures directly adjacent the base of the channel, and extend continuously around the outer periphery of the frame. The portion of the "C" joining the flanges, or body portion of the "D", which may be solid or hollow, constitutes the main structural part of the frame, and is not pierced with, and weakened by, stringing-receiving apertures, or is only provided with a small number of such apertures which do not affect significantly the strength of the frame.

The frame may be formed from laminations of wood or other material, from synthetic plastics material which may be fibre-reinforced, from metal such as aluminium or other light metal alloys, or from combinations of these materials.

The part of the frame defining the outwardly opening channel may be formed integrally with the main structural part or may comprise a separate elongate element or strip carried by, and preferably secured to, the outer periphery of a separate main structural part, or a part built up on the main part.

Since the stringing-receiving apertures open into the channel, the ends of the stringing may terminate, and may be knotted-off, within the channel. Furthermore, parallelism between the opposing string portions may be simply achieved by passing the stringing between the inner ends of circumferentially adjacent apertures within the channel. Thus, the problems associated with knotting-off, initial stringing, re-stringing and string parallelism, may be effectively eliminated.

Since the channel is not formed in the main structural part of the frame, and since the stringing-receiving apertures are formed in the flanges which define the side walls of the channel, the strength and stiffness of the frame is not significantly impaired thereby. Since the flanges are not necessarily required to contribute to the strength of the frame, the weakening effect of the stringing-receiving apertures may be relatively unimportant, in which event their disposition, configuration, etc, may be solely dictated by the requirements of the double-stringing. For example, the number of apertures may be increased so that the stringing only passes once through each, or at least the majority, of the apertures, which enables the aperture diameter to be minimised, and also simplifies initial stringing, re-stringing and knotting-off.

The present invention also consists in an elongate strip, attached, or attachable, to the outer peripheral surface of the head frame of a games racket of the type comprising a handle intended to be held in the hand, and carrying the head frame which defines a central opening, across which extends tensioned stringing carried by the frame, the stringing being composed of two sets of stringing, with each set being disposed in a respective one of two spaced generally parallel planes, wherein the elongate strip is fromed from a relatively hard synethic plastics material and has an inner peripheral surface profiled to cooperate with the outer peripheral surface of the frame, the strip further including an outer peripheral surface, a channel extending longitudinally of the strip and opening into the outer peripheral surface, and a pair of opposite side surfaces or flanges extending between the inner and outer peripheral surfaces of the strip, the strip being provided with stringing-receiving apertures distributed therealong, extending between the opposide side surfaces of the strip, opening at their outer ends into the opposite side surfaces, and opening intermediate their outer ends into the channel the apertures being dimensioned and arranged so that, when the strip is operatively assembled to the frame, they receive and locate stringing in said two sets.

In order that the invention may be more readily understood, various embodiments thereof will now be described with reference to the accompanying schematic drawings, in which:

DESCRIPTION OF ILLUSTRATED EMBODIMENTS

Figure 1:
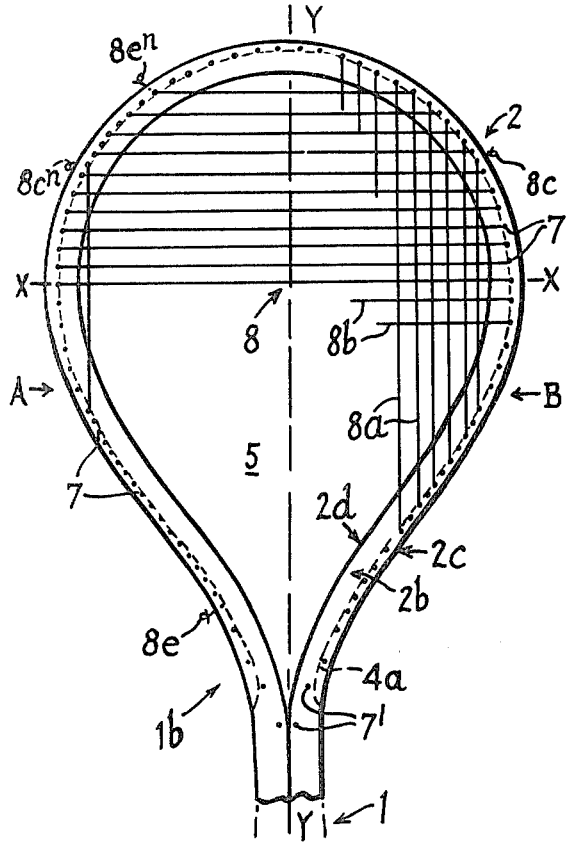
FIG. 1 is a plan view of a first embodiment of tennis racket, of laminated wood construction, with parts of the stringing omitted for clarity.

FIG. 1 shows a racket, such as a tennis racket including a handle or shaft 1 having a hand grip 1*a* at its butt end, and connected by a neck 1*b* to a head having a frame 2. As will be apparent from FIG. 2, the frame 2 basically comprises wood laminations 2*a*, the opposed side surfaces 2*b* of the frame comprising facings of a reinforcing material, for example one or more strips or layers 3 of wood, or fibre-reinforced plastics such as glass, graphite or boron fibre, bonded to the side surfaces. A channel 4 is routed out of the outer peripheral surface 2*c* of the frame, the channel 4 extending continuously around the central opening 5 defined by the frame 2, and terminating at or adjacent opposite sides of the neck 1*b*. The base 4*a* of the channel is indicated in broken lines in FIG. 1.

Figure 2:
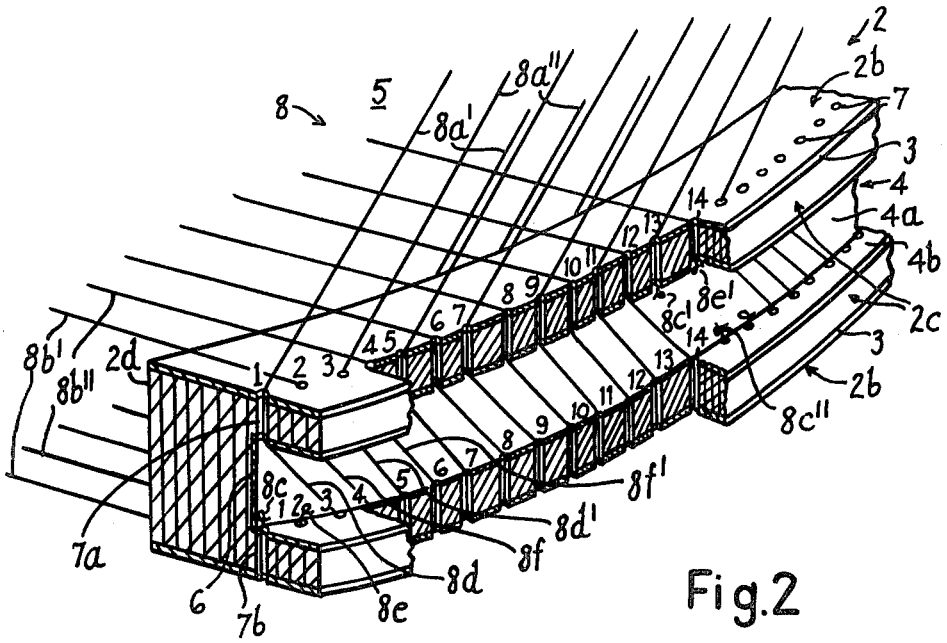
FIG. 2 is a perspective view of a portion of the head frame of a racket embodying the invention, such as the racket of FIG. 1, on an enlarged scale, with the flanges partly broken away for clarity.

As shown in FIG. 2, the sides 4*b* and base 4*a* of the channel 4 are provided with a sealant or protective film or coating 6 which may, for example, comprise a vulcanised fibre coating which is applied to the channel, the frame being subsequently placed in a mould and heated or otherwise treated to bond the coating 6 to the frame. The coating may optionally extend over some or all of the external surfaces of the frame, i.e. over the portions of the outer peripheral surface portions 2*c*, over the reinforcing strips or layers 3, and/or over the inner peripheral surface 2*d*.

Stringing-receiving apertures 7 are then bored, punched or otherwise formed between, and opening into, opposed side surfaces 2*b* of the frame, the axes of the apertures 7 being mutually parallel, and perpendicular to the planes of the side surfaces. The apertures 7 are positioned so that they open into the channel 4 immediately adjacent the base 4*a* thereof, i.e. they extend through the opposed flanges of the laminated frame which define the sides 4*b* of the channel 4. Thus, each aperture is composed of two axially aligned aperture portions 7*a* and 7*b* in the opposed flanges.

The inner and outer ends of the aperture portions 7*a* and 7*b* are suitably chamfered or bevelled to minimise stresses on, and chafing of, the stringing.

A stringing filament 8 is passed through the stringing-receiving apertures 7 in the frame, back and forth across the central opening 5, as will be described hereinafter in detail, so as to produce two interconnected sets of appropriately tensioned string portions, one set 8*a*, 8*b* lying in a plane which is generally flush with the plane of that side surface of the frame which is uppermost in FIG. 1 and the other set lying in a plane generally parallel to the plane of the first set, and generally flush with the plane of the opposite side surface of the frame which is lowermost and concealed in FIG. 1.

The string portions of the lower set extend parallel to, and are disposed directly beneath and are therefore obscured by, the opposed string portions of the upper set 8*a*, 8*b* as viewed in FIG. 1. Each set comprises two groups of substantially parallel string portions, the string portions of the group 8*a* being generally perpendicular to, and interwoven with, the string portions of the other group 8*b*. The distribution of the apertures 7 around the frame 2 is such that the mutual spacing of the string portions in both groups in each set is the same as, or similar to, that of the string portions of a conventional centrally strung racket, although this is not essential. However, as will be apparent from FIG. 1, additional apertures are provided so that the string portions of the group 8*a* pass through one set of apertures, the apertures in that set alternating with apertures in a second set through which the string portions of the group 8*b* pass, so that the stringing filament only passes once through each of the individual apertures portions 7*a* or 7*b*, or the majority thereof.

In order to achieve parallelism between, and superimposition or alignment of, the opposed string portions in the groups in the upper and lower sets, the racket is strung as will now be described with reference in FIG. 2. To facilitate understanding of the stringing sequence, adjacent apertures 7 have been numbered, and the aligned upper and lower aperture portions 7*a* and 7*b* of the same aperture have been given the same number.

Referring, for convenience, to the string portions 8*a*, an end of a stringing filament is knotted-off at 8*c* within the channel 4 to anchor it at the inner end of, for example, the lower aperture portion (1). The filament passes downwardly out of the latter aperture portion (1), is flexed at right angles to extend across and in contact with the lower side surface 2*b* of the frame 2, i.e. the layer 3, across the central opening 5, across and in contact with the lower side surface (not shown) of the frame on the opposite side of the central opening, up through the aligned lower and upper portions of a single corresponding aperture, back across the central opening and down through the upper aperture portion (1). The lower and upper string portions 8*a*′ thus formed are mutually parallel and exactly superimposed. The string portion 8*d* leaving the upper aperture portion (1) within the channel 4 is directed diagonally to and downwardly through the lower aperture portion (3) of the next-but-one aperture, from which it passes across the central opening to and upwardly through the aligned lower and upper portions of a corresponding next-but-one aperture in the frame on the opposite side of the central opening, back across the central opening, and down through the upper aperture portion (3). The lower and upper string portions 8*a*″ are thus mutually parallel and superimposed and parallel to the string portions 8*a*′. The string portion 8*d*′ leaving the upper aperture portion (3) is directed diagonally to and downwardly through the lower aperture portion (5) of the next-but-one aperture. The previously described sequence is repeated until it is required to knot-off the stringing filament within the channel, for example as indicated at 8*c*′, the next length of filament commencing with the knotted end 8*c*′.

The string portions 8*b* are similarly strung using the intermediate alternate apertures (2), (4), (6), etc. For example, starting at the knotted end 8*e* within the channel 4, a stringing filament passes down through the lower aperture portion (2), across the central opening 5, up through the aligned lower and upper portions of a single corresponding aperture in the frame on the opposite side of the central opening, back across the central opening and down through the upper aperture portion (2). The lower and upper string portions 8*b*′ thus formed are mutually parallel and superimposed, and extend at right angles to the string portions 8*a*, 8*a'*, etc., with which they are interwoven. The string portion 8*f* leaving the upper aperture portion (2) within the channel 4 is directed diagonally to and through the lower aperture portion (4) of the next-but-one aperture, and the sequence is then repeated as previously described until knotting-off is effected, for example at 8*e'*.

In FIG. 2, knotting-off has been illustrated after relatively short stringing runs purely for purposes of illustration and in practice, longer stringing runs and consequently fewer knots will usually be employed, although this is not essential.

Figure 3:
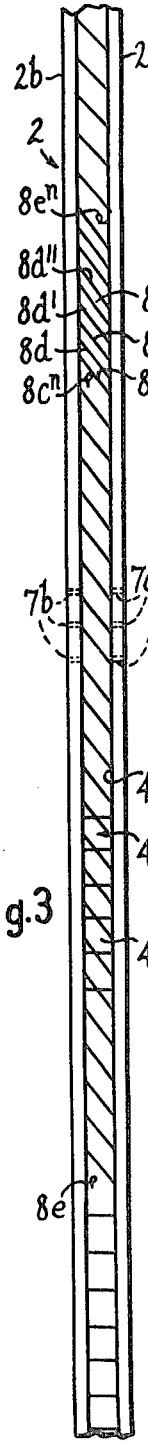
FIGS. 3 and 4 are side or edge views of portions of the head frame of a racket embodying the invention, such as that of FIG. 1 (or FIG. 6) on an enlarged scale, in that direction of the arrows "A" and "B" respectively.
Figure 4:
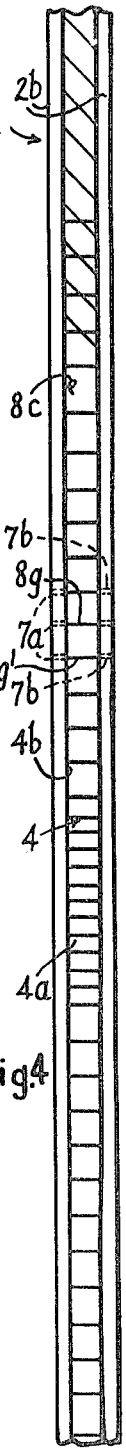

FIGS. 3 and 4 are edge views, respectively from the right and left of the head frame of FIG. 1, showing certain of the interconnecting or bridging portions in one of various alternative stringing configurations.

The vertical or main string portions 8*a* in FIG. 1 may be strung by means of one filament, or a series of filaments, extending between the knots shown diagrammatically at 8*c* and 8*c*$^n$. Thus, the diagonal interconnecting portions (8*d*. 8*d'*, 8*d''*, etc. in FIG. 2) will be located in the channel 4 above the line X—X in FIG. 1, and the interconnecting portions which extend parallel to the aperture axes (not shown in FIG. 2) will be located below the line X—X. These diagonal portions 8*d*, 8*d'*, 8*d''*, etc, and parallel portions 8*g*, 8*g'*, 8*g''*, etc, are shown in FIG. 4, as well as the diagonal portions 8*f*, 8*f'*, etc. The location of the diagonal portions above the line X—X, and particularly around the top of the frame, is advantageous since the location of the parallel portions below the line X—X enables the stringing sequence to be maintained where it passes through the apertures 7' in the frame where it blends with the handle 1, which apertures are each continuous, are not interrupted by the channel 4, and are perpendicular to the planes of the side surfaces 2*b*. The knot 8*c* is shown in FIG. 4, whilst the knot 8*c*$^n$ which is located on the other side of the line Y—Y is shown in FIG. 3.

The transverse string portions 8*b* in FIG. 1 may likewise be strung by means of one filament or a series of filaments, extending between the knots shown at 8*e* and 8*e*$^n$ in FIGS. 1 and 3. Thus, the diagonal interconnecting portions (8*f*, 8*f'*, 8*f''*, etc, in FIG. 2) will be located in the channel 4 to the riight of the line Y—Y in FIG. 1, and the interconnecting portions which extend parallel to the aperture axes (not shown in FIG. 2) will be located at the left of the line Y—Y. These diagonal portions 8*f*, 8*f'*, 8*f''*, etc., are shown in FIG. 3, as well as the diagonal portions 8*d*, 8*d'*, etc.

The overall cross-sectional dimensions of the frame 2 in the embodiment of FIGS. 1 to 4 may be similar to that of the frame of a conventional centrally strung racket. For example, the frame 2 may be square in cross-section, the width of the frame 2 between the opposite side faces 2*b* of the layers 3, and the thickness of the frame in a radial direction, may be of the order of 16 mm. In this event, the depth and width of the channel 4 may be of the order of 6 mm. and 7 mm., respectively. The provision of the channel 4 reduces the overall weight of the frame, but with the specific dimensions of the channel, the strength and stiffness of the frame is not significantly reduced. This is because the cross section of the frame, as viewed in FIG. 2 can be considered to resemble an "extended D", the extensions of the "D" comprising the flanges forming the sides 4*b* of the channel, and the main body of the "D" being formed by the box-section solid main structural frame part between the base of the channel and the inner peripheral surface of the frame, from which the flanges project. Thus, with this configuration, an adequate amount of material remains at the zones of the greatest stress in bend of the frame.

Figure 5:
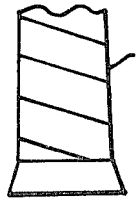
FIG. 5 is a cross-section through a modified laminated wood frame.
Figure 5:
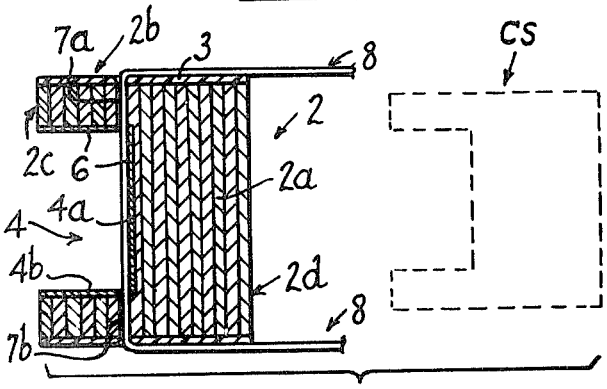

By modifying the dimensions of the laminated wood frame as shown in FIG. 5, a stiffer "extended D" section frame may be obtained. In this embodiment the width of the frame (between the layers 3) is increased, for example from 16 mm, to approximately 20 to 22 or 25 mm., whilst retaining the same radial thickness of approximately 15 or 16 mm. In this event, the channel 4 retains the same depth of approximately 6 mm. but has an increased width of the order of 12 to 14 mm.

The cross-sectional profile of a conventional centrally-strung rectangular frame is shown in broken lines at CS in FIG. 5 for purposes of comparison. The cross-sectional area of the frame, which has a radial thickness and a width of 16 mm., is 256 mm$^2$., whilst, despite its increased width, the cross-sectional area of the modified frame shown in full lines in FIG. 5 is reduced by approximately 14 percent to 224 mm$^2$. The frame of FIG. 5 is therefore correspondingly lighter, offsetting the increased weight of the double-stringing. Since the width of the frame is increased from 16 to 22 mm., it is stiffer in bend than a conventional frame, whilst at the same time, it is strong enough to withstand the doubled inward tension exerted by the double-stringing and possesses adequate roll or torsional stiffness. Thus, with the cross-section as shown in FIG. 5, it is possible to make an acceptably stiff, laminated wood, double-strung racket having a head frame which is larger than was hitherto considered to be feasible, and without unacceptably increasing the head weight.

Since wood is more compatible with stringing than are some other materials, and provided that the layers 3 are also sufficiently compatible with the stringing, or are configured in the regions of the stringing-receiving apertures 7 so as to avoid chafing of the stringing, it will not be necessary to protect the stringing by means of resilient inserts such as grommets or sleeves where it passes through the apertures in the frames of FIGS. 1 to 5. However some or all of the apertures 7,7' may be fitted with inserts if required.

Figure 6:
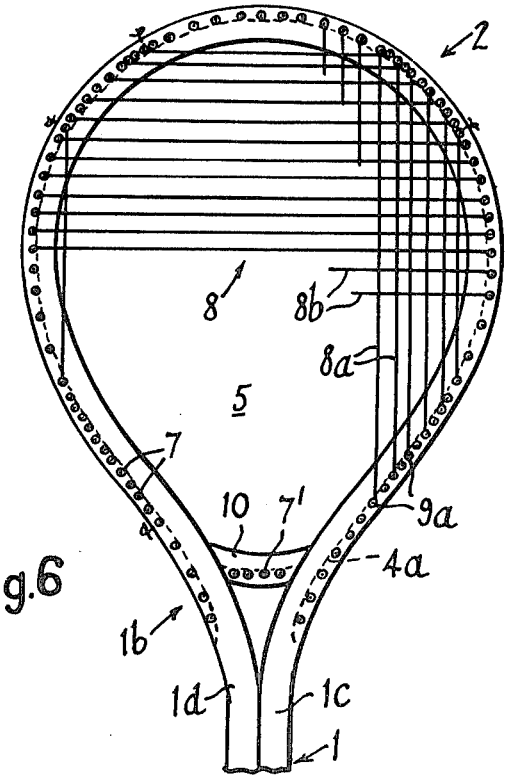
FIG. 6 is a plan view of a second embodiment of tennis racket, with parts of the stringing omitted for clarity.
Figure 11:
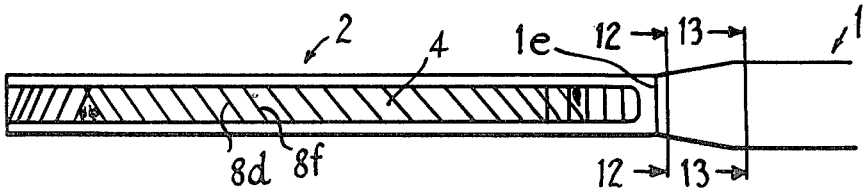
FIG. 11 is a side or edge view of the racket shown in FIG. 6.

The frame of the racket shown in FIGS. 6 and 11 is formed from a less compatible material or materials, for example a synthetic plastics material, a metal, combinations thereof or combinations thereof with wood. When a plastics material is employed, it is preferably reinforced, for example by appropriately oriented fibres of glass, "Kevlar", graphite, boron, or other reinforcing material, set in an epoxy or other suitable plastics matrix. When a metal is employed, it may be steel although it is preferably a light metal or light metal alloy, such as aluminium or an aluminium alloy. The frame may be basically similar in plan or profile to that shown in FIG. 1, and dimensionally similar to that shown in FIG. 5. However, the stringing-receiving apertures 7 have a slightly enlarged internal diameter to accommodate resilient inserts, for example Nylon grommets, the heads 9*a* of which are shown in FIG. 6. The number and location of the stringing-receiving apertures 7 are the same as in FIG. 1, although, in the region of the neck 1*b*, the frame 2 is spanned by a throat piece 10 provided with apertures which are equivalent to the apertures 7' of FIG. 1. Thus, the stringing 8 is, or may be, identical to that of FIG. 1.

When the frame is made from a fibre-reinforced plastics material, it may have one of the cross-section shown in FIGS. 7 to 10.

Figure 7:
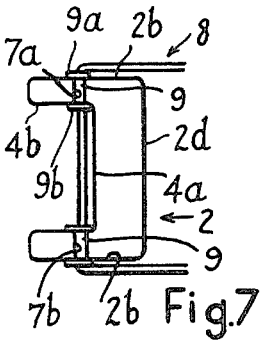
FIGS. 7, 8, 9 and 10 are various alternative cross-sections, on an enlarged scale, which may be adopted for the frame of the racket shown in FIG. 6, when formed from a synthetic plastics material.

In FIG. 7, the frame is formed from a tube, the wall of which defines a hollow "extended D" section. The main structural part of the frame comprises the hollow box section defined between the inner peripheral surface 2*d*, the base 4*a* of the channel 4, and the portions of the opposed side surfaces 2*b* intermediate the surface 2*d* the base 4*a*. The extensions or flanges of the "D" which define the sides 4*b* of the channel are hollow, and are formed with aperture portions 7*a* and 7*b* press-fitted with grommets 9 through which the stringing 8 passes. In this embodiment, the grommets 9 each have an outer head 9*a* resting on the associated side surfaces 2*b*, and after fitting the grommet, its inner end is spun over or otherwise formed into an inner head 9*b*. Alternatively the inner head 9*b* may be preformed, for example to a smaller diameter or size than the outer head, and rounded or otherwise formed with a lead-in surface, to enable it to be resiliently snapped into and through the associated aperture portion to positively lock the grommet in place.

Figure 8:
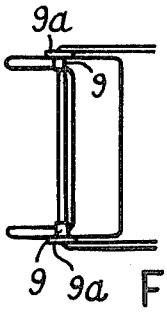

The frame cross-section shown in FIG. 8 is similar to that of FIG. 7, except that the flanges defining the channel side walls 4*b* are solid. This may be achieved by pressing and preferably bonding together the walls of each flange, or by initially producing the flanges in solid form. The grommets 9 in this embodiment have heads at their outer ends but not inner ends, although grommets corresponding to those of FIG. 7 could be employed. Likewise the FIG. 7 frame could employ grommets of the form shown in FIG. 8. The FIG. 8 flange configuration enables shorter grommets to be used, and modifies the strength of the flanges.

Figure 9:
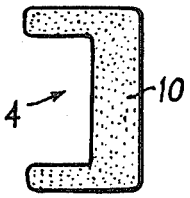

The frame cross-section of FIG. 9 is identical to that of FIG. 7, except that the hollow tube is provided with a core 10, for example filled with a cellular material such as an expanded structural foam of synthetic plastics material, which may be polystyrene. The core serves to further reinforce the frame, and for this reason, is preferably bonded to the interior of the tube. The core also possesses damping and anti-vibration characteristics.

The frames of FIGS. 7 to 9 may be made by any appropriate technique. For example a seamless plastics tube of appropriate wall thickness, and with appropriately oriented reinforcing fibres, may be moulded, or possibly extruded or pultruded, to the required final profile by known methods taught by Staub Brothers of Starwin Industries, Dayton, Ohio, U.S.A., or by Babcock and Wilcox of Alliance, Ohio, U.S.A. Alternatively, the tube may be formed to its final profile, i.e. the channel 4 may be produced after formation of the tube, and this may be effected by expanding the tube into contact with appropriately contoured mould surfaces. Expansion may be effected by means of internal pressure produced by compressed air or other gas or liquid, or, in the FIG. 9 embodiment, by the expanding foam of the core 10.

Alternatively, in the FIG. 9 embodiment, the core 10 may be preformed to the required profile and curved or hoop form, and the tube then built up by laying up and orienting the reinforcing fibres or fibre matting on the core, and applying the resin binder thereto. Additionally, or alternatively, a sleeve of reinforcing fibres may be drawn over the core 10, and applied to the contours thereof whilst the resin binder is hardening.

Figure 10:
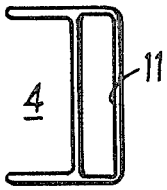

In FIG. 10, the core 10 of FIG. 9 is replaced by an inner sleeve 11, preferably of fibre-reinforced plastics material. This may be achieved by firstly forming the outer "extended D" section tube or shell, and subsequently building up the inner tube 11 therein. Alternatively, a collapsed inner tube, such as a woven a seamless reinforcing-fibre tube or sleeve, may be inserted into the outer tube, whereafter the inner tube is inflated and expanded into contact with the outer tube, and is bonded thereto. The inner tube 11 may extend around the head frame only, or may extend down within the shaft. In this embodiment as in that of FIG. 9, since the outer tube or shell is reinforced by the inner core 10 or sleeve 11, the wall thickness of the outer tube may be correspondingly reduced.

The stringing-receiving apertures 7 in the embodiments of FIGS. 6 to 10 may be formed, for example punched or drilled, in the flanges of the formed tubes, or may be formed during manufacture or shaping of the tubes.

Figure 12:
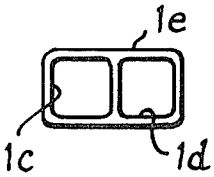
FIGS. 12 and 13 are cross-sections on the lines 12—12 and 13—13 respectively in FIG. 11, when the racket is formed from a synthetic plastics material.
Figure 13:
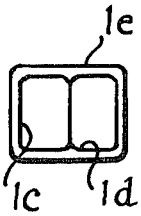

As will be apparent from FIG. 6, the channel 4 terminates in the region of the neck or throat 1*b*, and the hollow rectangular continuations 1*c* and 1*d* of the frame 2 are curved and brought together to form the shaft or handle 1 of the racket. The continuations 1*c*, 1*d*, which may be bonded together, are preferably enclosed in a common seamless fibre-reinforced plastics sleeve 1*e* which may be preformed or formed in situ, and is preferably bonded to the continuations 1*c*, 1*d*, thus producing a strong, rigid shaft. As shown in FIGS. 11, 12 and 13, the rigidity of the shaft 1 may be increased by increasing the width of the handle in a direction normal to the playing surfaces, from a position adjacent the neck or throat (FIG. 12) towards (FIG. 13) and to, the butt end of the shaft 1 beneath the hand-grip portion (not shown).

Figure 14:
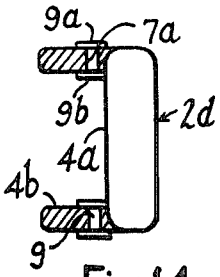
FIGS. 14, 15 and 16 are various alternative cross-sections, on an enlarged scale, which may be adopted for the frame of the racket shown in FIG. 6 when formed from a metal.
Figure 15:
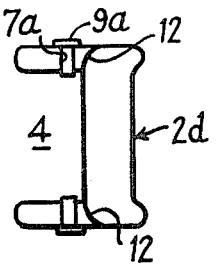
Figure 16:
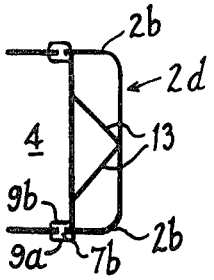

When the frame of the racket shown in FIG. 6 is made from aluminium or an aluminium alloy, it may be extruded to one of the various cross-sections shown in FIG. 14, 15 or 16.

The extrusion forming the frame shown in FIG. 14 is of similar cross-section to that shown in FIG. 8, and comprises a tubular box-section main structural part between the base 4*a* of the channel and the inner peripheral surface 2*d*, provided with integral solid flanges defining the sides 4*b* of the channel.

The extrusion forming the frame shown in FIG. 15 is similar to that of FIG. 7, and has a tubular box-section main structural part provided with integral hollow flanges. These flanges and the main structural part, are stiffened, and the box-section is completed, by integral webs 12 at the roots of the flanges.

The extrusion shown in FIG. 16 is similar to that of FIG. 14, in that it embodies solid flanges. However, the tubular main structural part is internally braced by webs 13. In addition, the flanges are thinner, and radially shorter, than the flanges in FIG. 14, and the overall width of the frame between the side surfaces 2*b* is increased.

The flanges of the extrusions in FIGS. 14, 15 and 16 are formed with stringing-receiving apertures 7 fitted with resilient grommets 9 as described with reference to FIGS. 7 and 8. However, the grommets may be made from metal instead of plastics, in which event they will be formed with both internal and external heads corresponding to the heads 9*a* and 9*b* as shown in FIG. 16.

The frame of the racket shown in FIG. 6, when made from aluminium or an aluminium alloy, may be produced by drawing instead of extrusion. In this event, an appropriate cross-section or profile, for example similar to that shown in FIG. 7 or 8, will be employed. This drawing technique is employed when it is desired to vary the profile or cross-section in different regions around the head, at the throat, or between the throat and shaft or handle since the drawn tube may subsequently be readily deformed to the required local profile or cross-section.

The grommets 9 shown in the embodiments of FIGS. 7 to 10 and 14 to 16 may be individual grommets, individually assembled within their associated aperture portions 7a, 7b. Alternatively as described in my aforesaid Specification, the grommets 9 associated with each flange or side surface 2b may be integrally interconnected by a web, the web being joined to, or replacing, the outer heads 9a, spacing the grommets apart by distances corresponding to the mutual spacing of the associated apertures 7, and lying on the side surface 2b.

In the embodiment described with reference to FIGS. 4 to 8 of my aforesaid Specification, a particularly advantageous racket construction is disclosed, in which the head is of composite form, comprising an inner main structural part, devoid of stringing-receiving apertures, carrying, around its outer periphery a separate strip formed with the stringing-receiving apertures. The present invention may advantageously be applied to this construction, as will be now described.

Figure 17:
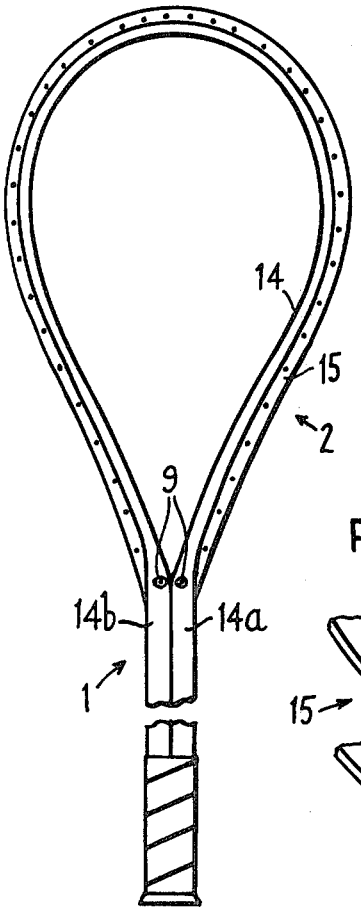
FIG. 17 is a plan view of a third embodiment of racket, with parts of the stringing omitted for clarity, employing a composite, i.e. multi-part, frame.

Referring to FIG. 17 there is shown a racket, having a head frame 2 which is composite in that it includes an inner main structural part 14 secured to or integral with the shaft or handle 1. The main part 14 may be formed from any of the previously mentioned frame materials, i.e. wood, plastics or metal, or combinations thereof. The main part 14 is substantially devoid of stringing-receiving apertures, and carries around its outer periphery, a circumferentially continuous or interrupted elongate strip 15 which is provided with an outwardly opening channel, and stringing-receiving apertures, corresponding to the channel 4 and apertures 7 in the preceding embodiments.

The strip 15 may be formed from a synthetic plastics material which is preferably substantially incompressible but possesses a degree of flexibility to enable it to be curved around the main part 14, which is compatible with the stringing so as to render grommets unnecessary, and which has a good resistance to abrasion. Nylon, fibre-reinforced or alone, is among the preferred materials.

In FIG. 17, the frame is throatless, having a deep "V" configuration where it blends into the shaft, and the frame is of generally "tear-drop" outline. However, the frame may be of any other appropriate outline, and could be provided with a throat piece. Continuations 14a and 14b of the main part 14 form the shaft 1, and they may be bonded together, and/or encased in a reinforcing sheath as previously described, or may be spaced apart and interconnected by strong braces to resist twist. With the throatless construction shown, the two centre vertical string portions at their ends adjacent the neck, pass through apertures in the main part 14 instead of the strip 15, and the latter apertures are provided with grommets 9.

Figure 18:
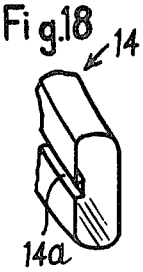
FIGS. 18, 19 and 20 are fragmentary perspective views of three alternative cross-sections, on an enlarged scale, which may be adopted for the main structural part of the frame of the racket shown in FIG. 17.
Figure 24:
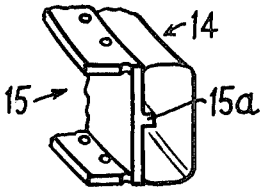
FIG. 24 is a cross-section through the assembled main structural part and elongate element of FIGS. 18 and 21 respectively.

FIG. 18 shows an appropriate cross-section for the main structural part 14, which may be hollow, or filled with a core, if formed from a plastics material or metal, and solid if formed from wood. The outer peripheral surface of the frame is formed with a circumferential groove 14a, and the associated elongate strip 15 shown in FIG. 21 is provided with a corresponding rib 15a which serves to positively correctly locate the strip 15 relative to the main part 14 as shown in FIG. 24.

Figure 19:
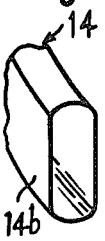
Figure 21:
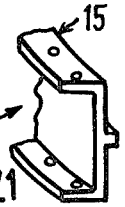
FIGS. 21, 22 and 23, are fragmentary perspective views of three alternative cross-sections of an elongate element or strip intended to be fitted to the frame parts of FIGS. 18, 19 and 20 respectively.
Figure 22:
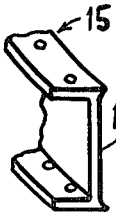

The cross-sections of the main part 14 shown in FIG. 19 and associated strip 15 shown in FIG. 22 are similar to those of FIGS. 18 and 21 respectively, except that the groove and rib are omitted, and the inner peripheral surface 15b of the strip 15 is rendered gently concave to correspond to, and fit, the contours of the outer peripheral surface 14b of the main part.

Figure 20:
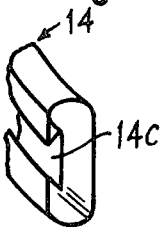
Figure 23:
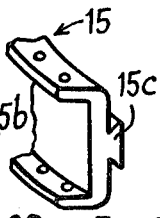
Figure 25:
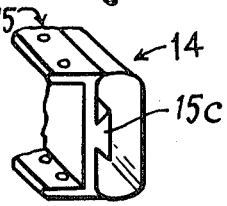
FIG. 25 is a cross-section through the assembled main structural part and elongate element of FIGS. 20 and 23 respectively.

When the main part and strip are formed by extrusion or a similar technique, as shown in FIGS. 20, 23 and 25, the main part may be provided with a dove-tailed groove 14c within which a corresponding dove-tailed rib 15c on the strip is engageable to positively anchor the strip to the main part.

Each strip just described may be retained in position on its associated main part by the tension of the stringing, although the strip could additionally be attached, for example by screws, to the main part at spaced points, for example 5 key points, around the frame, and/or may be bonded to the main part, to ensure that the strip does not become displaced during stringing, and to enhance the reinforcing effect of the strip on the main part.

The stringing may be effected and arranged as previously described.

The strip 15 may be formed in various ways, for example by molding, such as injection moulding, or extrusion. Whilst extrusion may initially be less costly than molding, the stringing-receiving apertures will have to be formed as a subsequent operation in an extruded strip, for example by punching or drilling, whereas moulded strips may be formed with stringing-receiving apertures during molding. However, extruded strips possess the advantage that they are more versatile, since the same extruded profile may be used for racket frames of varying shapes and sizes, from "junior" through to "oversize", by modifying the pattern of the stringing-receiving apertures to suit. Moreover, extrusion enables the required length of strip to be readily produced in one piece, whereas this may not always be possible, or may be excessively expensive, with molding techniques.

Figure 26:
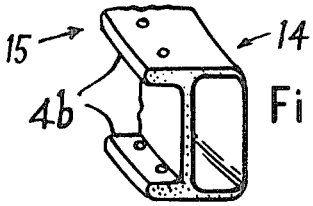
FIG. 26 is a further alternative cross-section for a composite frame.

The frame shown in FIG. 26 comprises a main structural part 14, which may be solid, or a seamless hollow tube, made from one of the previously mentioned materials. Bonded to, and built up upon the main part 14 is a strip 15 comprising a skin formed from a plastics resin or matrix, moulded to form the channel 4 and flanges forming the channel side walls 4b. The resin or matrix may be reinforced, for example by fibres, such as chopped graphite fibres. The stringing-receiving apertures may be formed, during formation of the strip 15, by means of pins or the like in the mold.

The main parts 14 of FIGS. 14, 15, 18 to 20, and 26, may be internally reinforced, for example by means of an internal tube corresponding to the tube 11 in FIG. 10. When the main part 14 is formed from aluminium, for example drawn aluminium, the inner tube may also be of drawn aluminium, or of extruded aluminium. The inner tube may be inserted whilst both tubes are straight, and a bonding liquid introduced between the two tubes prior to bending. The two tubes are bent by cold forming to the required frame curvature before the bonding liquid sets, thus forming, after setting, a particularly strong frame. The thickness of the walls of the inner and outer tubes may be proportionally reduced to give the correct and required unstrung racket weight. In all of the preceding embodiments, the channel 4 is generally rectangular in cross-section, the stringing-receiving apertures 7 are perpendicular to the planes of the opposed side surfaces 2*b* and the playing surfaces, and the aperture side surfaces 7*a* and 7*b* of each aperture are coaxial.

Figure 27:
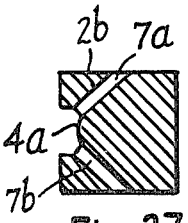
FIGS. 27 to 31 are views of various other embodiments of frames.
Figure 28:
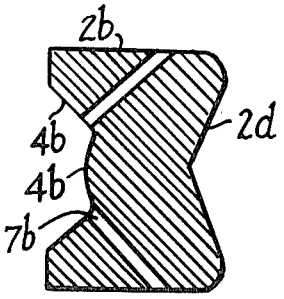

In the embodiments shown in FIGS. 27 and 28, the width of the channel 4 is decreased (i.e. the thickness of the flanges is increased), and the depth of the channel (i.e. the radial height of the flanges) is decreased to an extent that it is merely sufficiently deep to accept crossed over bridging or interconnecting portions, and the internal knots. In these embodiments, the portions 7*a* and 7*b* of each stringing-receiving aperture are mutually inclined, for example at an angle of approximately 45° to the side surfaces 2*b*, and the base 4*a* of the channel is curved or convex to blend into the inner ends of the aperture portions. Since the depth and width of the channel is decreased to a minimum, any detremental effect of this channel on the strength or stiffness of the frame is minimised. Due to the inclination of the aperture portions 7*a* and 7*b* the angle through which the stringing is flexed where it passes into the outer ends of the aperture portions is reduced from approximately 90° to approximately 45°. The 90° flexure of the interconnecting or bridging portions is progressively distributed between the inner ends of the aperture portions, over a relatively large radius, by the convex base 4*a*.

As shown in FIG. 28, the walls 4*b* diverge outwardly, and are generally perpendicular to the aperture portions 7*a*, 7*b*. The inner peripheral surface 2*d* of the frame may also be relieved or channelled to reduce weight.

Figure 29:
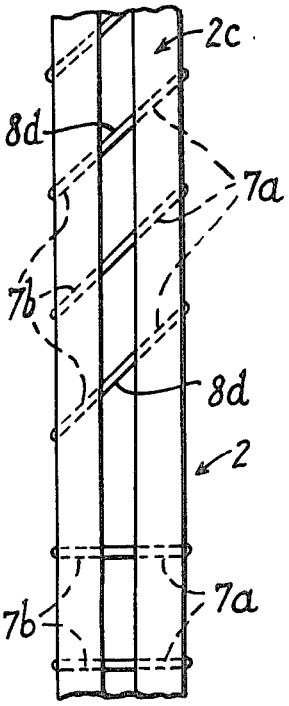

In a further modification, as shown in FIG. 29, the apertures 7 in any of the previously described embodiments, and in particular those of the aperture portions 7*a* and 7*b* which are spanned by diagonal interconnecting or bridging portions of the stringing, may be inclined so that, in the plane of FIG. 29, the angle of flexure of the bridging portions, where they pass into or out of the inner ends of the aperture portions, is significantly reduced, preferably to zero.

Figure 30:
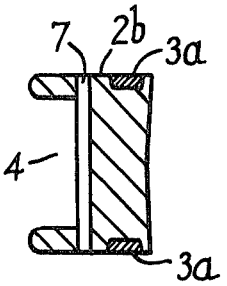

The laminated wood frames described with reference to FIGS. 1 to 5 are reinforced or strengthened by means of the layers 3 disposed in the regions of the apertures 7. This limits the materials which may be used for the layers to materials compatible with the stringing, or necessitates careful relieving or bevelling of the layers, if the stringing is not to be chafed thereby, otherwise grommets or the like are required. This restriction may be overcome, as shown in FIG. 30, by partially facing the side surfaces 2*b* with reinforcing strips 3*a* formed from, for example, a fibre-reinforced plastics material, extending at least partially around the circumference of the frame, and inset in and bonded or otherwise anchored to the main structural part of the frame. For example, by employing aligned or appropriately oriented boron fibres set in an epoxy matrix, an increased stiffness of the frame of up to 30 percent and more may be achieved. Since the strips 3*a* are inset in the side surfaces 2*b*, and are spaced inwardly of the stringing-receiving apertures 7, no significant chafing of the strings by the strips occurs.

When the reinforcing strips 3 or 3*a* are provided on or in the side surfaces 2*b*, the spacing between the wall surfaces, and therefore the strips, may be increased as much as is practicable, to enhance the reinforcing or stiffening effect of the strips. For example the spacing may approximate twice the radial thickness of the frame.

Figure 31:
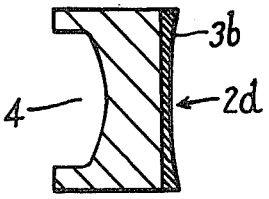

Alternatively (or additionally), to the modification of FIG. 30, as shown in FIG. 31, a reinforcing strip 3*b* may extend around the inner peripheral surface 2*d* of the frame. Such a strip, which may be formed from appropriately oriented or aligned graphite or boron fibres in an epoxy matrix, is bonded or otherwise anchored to the inner peripheral surface, thus considerably enhancing the stiffness and hoop strength of the frame without significantly increasing its weight. The strip may be circumferentially interrupted, or continuous, although, unless a throat piece is provided, the strip may terminate where the frame blends with the shaft or handle in preference to extending along the shaft FIG. 31 also illustrates a channel 4 of modified cross-section.

The rackets hereinbefore described possess numerous advantages.

Due to the provision of the channel 4, parallelism and precise alignment between the opposing string portions of the two playing surfaces may be simply achieved without having to pass the portions of the stringing which interconnect or bridge the ends of the string portions 8*a*,8*b* externally of the frame along tortuous paths involving the passage of the stringing several times through the individual stringing-receiving apertures. As a result, the internal cross-section or diameter of the stringing-receiving apertures, even with the provision of grommets or the like, may be reduced to a minimum, the warping or twisting effect on the frame produced by such external, circumferentially extending bridging or interconnecting portions is effectively eliminated, the length of the bridging portions is reduced to a minimum, the bridging portions are shielded and protected by the sides of the channel, and the aesthetic appearance of the racket is enhanced. The appearance of racket is further enhanced because the ends of the stringing terminate, and are knotted-off, within the channel. The performance of the racket is also improved, since the playing surfaces are not rendered uneven by external bridging portions or by external knots.

The parallelism of the string portions and the concealed knotting-off is effected without complicating the disposition of the stringing-receiving apertures. In all of the embodiments except those of FIGS. 27 to 29 these apertures 7, i.e. the axially aligned portions 7*a* and 7*b* thereof, are mutually parallel and are perpendicular to, and extend between, the planes of the two playing surfaces or opposed side surfaces 2*b*, thus simplifying and reducing the cost of production of the apertures, and also simplifying the stringing operation. Since stringing is achieved without flexing the stringing filaments through excessively sharp angles, i.e. without flexing the filaments through included angles of less than 90°, the resultant weakening of the stringing which would otherwise occur is avoided. The angles are reduced in the embodiment of FIGS. 27 to 29.

Due to the location and dimensions of the channel 4, the channel has negligible significant effect upon the strength and stiffness of the frame, even when applied to a frame of the dimensions of a conventional centrally-strung racket, for example as described with reference to FIGS. 1 to 4, and the weight reduction produced by the formation of the channel compensates for the extra weight of the additional set of stringing. Furthermore, when, as in the embodiments of FIGS. 5 to 31, the frame is specifically designed to incorporate the channel, the stiffness of the frame, i.e. the torsional rigidity or roll stiffness and the stiffness in bend, may be significantly increased without unacceptably increasing the weight of the head frame and/or modifying the balance of the racket, in fact, the frame may be lightened if necessary. This is because each frame is of "extended D" section and incorporates main structural or load bearing part of strong, rigid, solid or hollow, generally rectangular- or box-section, the strength of which is not impaired by the formation of stringing-receiving apertures therein, since the apertures are formed in the radially outwardly directed flanges which define the sides of the channel. The frame strength is not significantly impaired by the provision of the stringing-receiving apertures in the flanges, and the number, disposition and configuration of the apertures may be dictated primarily by the stringing requirements, thus giving freedom of stringing. This is of particular significance in fibre-reinforced frames where the formation of the stringing-receiving apertures could cut the oriented fibres and thereby further reduce frame strength. In any event, due to the fact that the internal diameter of the apertures may be reduced to a minimum, the strength of the flanges is enhanced, and the flanges contribute significantly to the strength or stiffness of the frame, particularly when the flanges are separated by a distance greater than the spacing between the side surfaces of the frame of a conventional centrally-strung racket.

Since the channel 4 is of generally rectangular cross-section, and the stringing-receiving apertures are located directly adjacent the base of the channel, not only may the depth of the channel be reduced to a minimum, but the bend and shear loads imposed on the flanges by the tensioned stringing is minimised.

Since the stringing passes only once through each of the stringing-receiving apertures, and since the main or vertical string portions 8*a* and the transverse string portions 8*b* pass through different apertures, initial stringing and re-stringing is simplified, and is not impaired by knotting-off or by frequent knotting-off. Thus individual string portions may be replaced and knotted-off at opposite ends, or a succession of string portions may be restrung as required.

Each racket of FIGS. 1 to 5 and 27 to 31 possesses the advantage that, since its frame is primarily formed from wood laminations which are compatible with the stringing, and outer layers which are either compatible with the stringing or positioned to avoid chafing the stringing, grommets or the like are unnecessary. The layers 3, 3*a*, 3*b* significantly reinforce, i.e. stiffen, the laminated part of the frame, and the flanges defining the channel side walls. In addition, the layers 3 in the embodiment of FIGS. 1 to 5 overly the flanges and prevent splitting of the frame, and in particular de-lamination of the laminates, for example due to the forces exerted by those string portions which exert a tension in the directions of the planes of lamination. The coating 6, which may also be applied to the frames of FIGS. 27 to 31, seals and protects the laminations from the external environment, and may also form a resilient cushion between the stringing and frame.

An advantage of the embodiments of FIGS. 27 and 28 that the stringing-receiving apertures pass through several adjacent laminations of the wood frame (which extend as shown in FIGS. 2 and 5), thus distributing the forces imposed by the tensioned stringing over a large number of laminations having differently oriented graining.

It will be understood that various modifications may be made without departing from the scope of the present invention as defined in the appended claims. For example, other profiles and cross-sections of frame, structural frame part, channel and flanges may be employed and other materials and combinations of materials may be employed for the frame and its components. For example, the tubular or solid main structural part may be rectangular, oval, circular, etc, and, when tubular, the wall thickness may be varied in a direction around the cross-section of the tube, and/or around the circumference of the frame. The frame could define a circular central opening 5, which would enhance the strength of the frame, enabling the thickness, for example wall-thickness, of the frame to be reduced, or the use of double, nested tubes to be avoided.

The apertures may be dimensioned and oriented as disclosed, although the vertical string portions and transverse string portions could, if required, use at least some common stringing-receiving apertures. This would necessitate enlarging the cross-sections of the apertures, or the grommets located therein. The apertures, and in particular the aperture portions 7*a* and 7*b* (or the apertures in the grommets) could be internally parallel-sided, or could be belled out towards their inner ends to decrease or eliminate the flexure in the bridging portions of the stringing where they pass diagonally from one aperture portion to another, or to increase the radius of flexure.

The stringing sequence or configuration could be varied, and, for example, the bridging portions, instead of being disposed mutually parallel to each other as shown in FIG. 2, could be arranged in other ways, for example they could cross over each other. The two central vertical string portions 8*a* may be located in apertures in the region of the handle, when no throat piece is provided, which are spaced apart by a distance greater than the required spacing between the string portions, in which event, the said string portions may be tied, for example wired, together adjacent these apertures to obtain the required spacing, the tie being anchored to the apertures to prevent it riding up the string portions. The string portions may extend diagonally, i.e. at 45° to the axis of the handle, instead of vertically and transversely, as shown in FIG. 4 of my aforementioned Specification.

Figure 32:
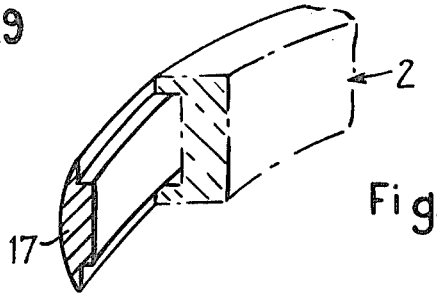
FIG. 32 is a fragmentary perspective view of a closure strip for use with the frames of the preceding Figures.

The bridging or interconnecting portions of the stringing may be protected by fitting a strip, for example a strip of Nylon or other plastics material, as shown at 17 in FIG. 32, around the outer peripheral surfaces 2*a*, in or over the channel 4 to close it. This closure strip, which will be detachable to permit re-stringing, may also serve as a strut between the outer extremities of the flanges defining the side walls 4*b*, and thus strengthen the flanges. In addition, the strip may protect the frame against damage if it overlies or stands proud of the surfaces 2*a*, for example should the frame strike the ground or other hard or abrasive playing surface of the court, and may also protect players from injury should they be struck by the frame. The embodiments of FIGS. 17 to 25 which employ a surround strip 15 will, in any event, possess the latter advantages, in addition to the advantage that the strip 15 may reinforce the structural part 14, and other of the advantages set out in my aforementioned Specification, but such a surround strip may still be provided with a closure strip 17 as just described.

To prevent the bridging portions of the stringing directly contacting the base of the channel in the embodiments described, and particularly in the embodiments in which the channel is formed in metal or fibre-reinforced plastics, a thin, light-weight resilient plastics strip may be placed between the bridging portions and base of the channel, to act as a cushion and/or as a damping device.

The stringing may be formed from a single or compound filament, i.e. natural gut or synthetic fibre, or of any other appropriate material.

The invention may be applied to various types of rackets, for example for tennis, squash, badminton, racketball, court or royal tennis, or the like.

Racketball rackets, and other rackets which are smaller and subjected to less stress than tennis rackets, may be formed in one piece from molded plastics, reinforced with fibres. The channel may be formed around the frame during molding, as may be the stringing-receiving apertures. The racket (for example of FIGS. 1 and 17) may have an integral or fitted throat-piece, or the throat (for example of FIG. 6) may be open.

When the racketball racket is formed from any of the previously mentioned materials, and especially when formed from metal, for example extruded aluminium, with a surround strip corresponding to the strip 15 shown in FIGS. 17 to 25, because of the said lower levels of stress, a metal throat-piece may be rivetted or otherwise attached to the shoulder where the frame meets the handle with less fear of cracking or metal fatigue at the shoulder. A small strip of Nylon or other semi-resilient plastics may be fixed to the underside, i.e. handle-side, of this throat-piece, of the same thickness as the main surround strip 15, formed with apertures or grooves to accept and locate the stringing. The throat-piece may be extruded and cut to size, or molded to its required size, the apertures or grooves being initially or subsequently formed in the throat-piece.

The stringing tension may be adjusted by deflecting the bridging portions of the stringing within the channel. For example, if the interconnecting or bridging portions are spaced from the base of the channel 4 (e.g. FIG. 31), the stringing may be tightened or loosened by tightening or loosening a strap or filament which overlies the bridging portions with the channel and extends circumferentially around the frame, and which is operable in the manner of a tourniquet to press the bridging portions towards the base.

When the stringing makes a single pass through the individual apertures, means may be provided, for example the grommets may be adapted, to lock the strings against movement therethrough, or resist movement therethrough, at least temporarily, in a direction from the channel towards the side surfaces, so that should a string portion break, the tension in adjacent string portions will not be significantly reduced.

I claim:

1. A games racket comprising a handle intended to be held in the hand, and carrying a head having a frame defining a central opening, across which extends tensioned stringing carried by the hand, the stringing being composed of two sets of stringing with each set being disposed in a respective one of two spaced generally parallel planes, and being composed of first and second groups of mutually parallel string portions, the string portions of the first group being interwoven with, and generally perpendicular to, the string portions of the second group, the stringing including portions interconnecting the string portions in the two sets, the interconnecting portions passing through apertures distributed around the periphery of the frame, opening at their outer ends into opposite side surfaces of the frame which are spaced apart in a direction generally normal to the planes of the stringing, the cross-sectional profile of the frame resembling an "extended D" having a body portion and extensions projecting generally transversely from the body portion adjacent opposite ends of the upright limb of the "D", said body portion constituting the main structural part of the frame and being effectively devoid of structurally weakening stringing-receiving apertures, and said extensions constituting a pair of flanges extending continuously around the outer periphery of the frame which define opposite side walls of a channel provided in the outer periphery of the frame and extending around the central opening, the stringing-receiving apertures each comprising a pair of aligned aperture portions formed on in each flange remote from the outer peripheral edges thereof and opening at their inner ends into the channel directly adjacent the base thereof, the number and disposition of the stringing-receiving apertures being such that the stringing passes only once through each of at least the majority of the aperture portions, with the interconnecting portions passing through and located in the stringing-receiving apertures and extending across the channel between the inner ends of the aperture portions in the two flanges, and with at least one of the ends of the stringing knotted-off within the channel, the knot anchoring the stringing with respect to one of the flanges adjacent the inner end of an associated aperture portion.

2. A racket according to claim 1, wherein the first and second aperture portions of at least the majority of the stringing-receiving apertures are coaxial and substantially perpendicular to the planes of the two sets of stringing, and have a minimum diameter which is less than approximately twice the stringing diameter and is less than one half the height of the side walls, and wherein the string portions of the first and second groups of one set of stringing extend parallel to, and are directly superimposed with respect to, the string portions of the first and second groups respectively of the other set of stringing, the disposition of the interconnecting portions of the stringing being such that the interconnecting portion at one end of each of the majority of string portions extends across the channel between the inner ends of, and through, the aperture portions of the same stringing-receiving aperture, whilst the interconnecting portion at the other end thereof extends across the channel between the inner ends of, and through, the aperture portions of different stringing-receiving apertures, and the stringing being composed of several stringing filaments, at least some of the ends of which are knotted-off within the channel and anchored against the inner ends of their associated aperture portions.

3. A racket according to claim 1, wherein the width of the frame between its opposite side surfaces is of the order of 20 to 25 mm.

4. A racket according to claim 1, wherein the ratio of the width of the frame between its opposite side surfaces, to the radial thickness of the frame is of the order of approximately 20 to 22:16.

5. A racket according to claim 1, wherein the flanges defining the side walls of the channel are formed integrally with the body portion.

6. A games racket comprising a handle intended to be held in the hand, and carrying a head having a frame defining a central opening, across which extends tensioned stringing carried by the hand, the stringing being composed of two sets of stringing, with each set being disposed in a respective one of two spaced generally parallel planes, and being composed of first and second groups of mutually parallel string portions, the string portions of the first group being interwoven with, and perpendicular to, the string portions of the second group, the string portions of the first and second groups of one set being exactly superimposed, and parallel, with respect to the string portions of the first and second groups respectively of the other set, the stringing including portions interconnecting the string portions in the two sets, the interconnecting portions passing through apertures distributed around the periphery of the frame, opening at their outer ends into opposite side surfaces of the frame which are spaced apart in a direction generally normal to the planes of the stringing, and having mutually parallel axes disposed generally normal to said planes, the cross-sectional profile of the frame being generally rectangular and defining a body portion which constitutes the main structural part of the frame and is not pierced by stringing-receiving apertures which would significantly reduce the strength of the body portion, with two opposed sides of the rectangle being extended beyond the body portion to form a pair of flanges having circumferentially uninterrupted outer peripheral edges, the flanges being rigid with the body portion and contributing to the strength of the latter, and defining opposite side walls of a channel provided in the outer periphery of the frame and extending around the central opening, the stringing-receiving apertures each comprising a pair of coaxial aperture portions formed one in each flange remote from the outer peripheral edges thereof, opening at their inner ends into the channel directly adjacent the base thereof and having a cross-sectional size sufficient only to accommodate a single stringing run, the stringing running only once through each aperture portion, with some of the interconnecting portions extending directly between the inner ends of the aperture portions of the same stringing-receiving apertures, with other of the interconnecting portions extending diagonally between the inner ends of the aperture portions of different adjacent stringing-receiving apertures, and with the terminal ends of the stringing knotted-off and anchored within the channel.

7. A games racket of the double-strung type, having a handle carrying a head frame defining a central opening, the head frame having a generally "D" profile in cross-section with a generally radially outwardly opening channel extending around the central opening, the circumferentially extending part of the frame disposed generally radially inwardly of the channel being effectively imperforate and constituting the main structural part of the frame, the channel having a pair of opposed side walls which are integral and structurally rigid with the main part of the frame and are circumferentially continuous, perforated with a plurality of generally circular stringing-receiving apertures distributed around the central opening and each comprising first and second opposed aperture portions, one in each side wall, spaced from the outer peripheral edge thereof, and opening at their inner ends into the channel, stringing means threaded only once through each aperture portion, and running back and forth across the central opening, to produce two interconnected spaced sets of interwoven stringing, one on each side of the frame with each run of stringing in one set in exact register with a corresponding run of stringing in the other set, the stringing means passing through the channel between and through aperture portions of the same stringing-receiving apertures to interconnect the runs of each pair which are in register, and passing through the channel between and through aperture portions of different stringing receiving-apertures to interconnect the runs of each registered pair with the runs of other registered pairs, and the stringing means, at its ends, being anchored within the channel, the aperture portions having a minimum diameter which is less than twice the diameter of the stringing and the height of the side walls being at least twice said minimum diameter, the ratio of the width of the frame between the outer surfaces of the side walls, to the radial thickness of the frame being of the order of 20 to 22:16, and said width being of the order of 20 to 25 mm.

8. An elongate strip, attached, or attachable, to the outer peripheral surface of the head frame of a games racket of the type comprising a handle intended to be held in the hand, and carrying the head frame which defines a central opening, across which extends tensioned stringing carried by the frame, the frame constituting a load bearing member which accommodates the forces exerted by the stringing, the stringing being composed of two sets of stringing, with each set being disposed in a respective one of two spaced generally parallel planes, wherein the elongate strip is formed from a relatively hard synthetic plastics material and has an inner peripheral surface profiled to cooperate with the outer peripheral surface of the frame, the strip further including an outer peripheral surface, a channel extending longitudinally of the strip and opening into the outer peripheral surface, and a pair of longitudinally continuous opposite side surfaces or flanges extending between the inner and outer peripheral surfaces of the strip, the strip being provided with stringing-receiving apertures distributed therealong, extending between and opening at their outer ends through the opposite side surfaces of the strip, each aperture comprising a pair of aligned aperture portions one piercing each flange at a location spaced inwardly from the outer peripheral edge of its associated flange and opening at its inner end into the channel, the apertures being dimensioned and arranged so that, when the strip is operatively assembled to the frame, they receive and locate stringing in said two sets, and the stringing spans the channel, within the channel, between the inner ends of the aperture portions.

* * * * *